US007314147B2

(12) United States Patent
DeCarlo et al.

(10) Patent No.: US 7,314,147 B2
(45) Date of Patent: Jan. 1, 2008

(54) COLLAPSIBLE STORAGE CONTAINER FOR OFFICE AND PERSONAL USE

(75) Inventors: Anthony J. DeCarlo, Bay Village, OH (US); Daniel V. Perella, Hudson, OH (US); Vincent J. Thomson, Avon Lake, OH (US)

(73) Assignee: Ideastream Consumer Products LLC, Parma, OH (US)

( * ) Notice: Subject to any disclaimer, the term of this patent is extended or adjusted under 35 U.S.C. 154(b) by 224 days.

(21) Appl. No.: 10/858,170

(22) Filed: Jun. 1, 2004

(65) Prior Publication Data

US 2004/0262307 A1 Dec. 30, 2004

Related U.S. Application Data

(60) Provisional application No. 60/474,698, filed on May 30, 2003.

(51) Int. Cl.
*B65D 6/00* (2006.01)
*B65D 8/14* (2006.01)
*A47J 39/00* (2006.01)

(52) U.S. Cl. ..... 220/6; 220/7; 220/592.27

(58) Field of Classification Search ..... 220/6, 220/7, 592.27
See application file for complete search history.

(56) References Cited

U.S. PATENT DOCUMENTS 3,303,986 A 2/1967 Tanaka
3,410,441 A * 11/1968 Rhyne ..... 220/4.28
3,724,920 A * 4/1973 Beck ..... 312/184
3,982,650 A * 9/1976 Ichihara ..... 220/4.28
4,782,972 A * 11/1988 Wenkman et al. ..... 220/4.28
D315,098 S 3/1991 Hutcheson
5,050,766 A * 9/1991 Groh ..... 229/101
D323,294 S 1/1992 Williams
5,193,701 A * 3/1993 Bush et al. ..... 220/4.33
D336,427 S 6/1993 Mainiero
D339,062 S 9/1993 Williams
5,494,161 A * 2/1996 Herbst ..... 206/425
D372,673 S 8/1996 Turner (Continued)

OTHER PUBLICATIONS

Yue On Offset Printing Factory Co., Ltd., Collapsible Box prior to May 30, 2003, 11 photos.

*Primary Examiner*—Anthony D. Stashick
*Assistant Examiner*—Shawn M. Braden
(74) *Attorney, Agent, or Firm*—Pillsbury Winthrop Shaw Pittman LLP

(57) ABSTRACT

A collapsible storage container apparatus having a base which has a first set of opposing edges and a second set of opposing edges. The container also includes a first set of opposing panels wherein each panel has a fold-over portion having at least one connector and one panel of the first set of opposing panels is attached to one of the first set of opposing edges and the other panel of the first set of opposing panels is attached to the other of the first set of opposing edges. The container further includes a second set of opposing panels wherein each panel has at least one connector matable with a connector of a panel of the first set of opposing panels and one panel of the second set of opposing panels is attached to one of the second set of opposing edges and the other panel of the second set of opposing panels is attached to the other of the second set of opposing edges.

4 Claims, 8 Drawing Sheets

U.S. PATENT DOCUMENTS 5,815,903 A * 10/1998 Foster et al. ..... 29/401.1
5,842,570 A * 12/1998 Turnbull ..... 206/425
5,931,326 A * 8/1999 Weng ..... 220/4.33
D414,335 S 9/1999 Cheyn
D418,751 S 1/2000 Wolf
D437,222 S 2/2001 Goldberg
6,189,776 B1 * 2/2001 Smith et al. ..... 229/117
6,220,473 B1 * 4/2001 Lehman et al. ..... 220/592.27
D457,313 S 5/2002 Clark et al.
6,431,580 B1 * 8/2002 Kady ..... 280/655
6,712,436 B2 * 3/2004 Chen ..... 312/348.1
D493,618 S 8/2004 DeCarlo et al.
D494,758 S 8/2004 DeCarlo et al.
D500,205 S 12/2004 DeCarlo et al.
D510,491 S * 10/2005 Perella et al. ..... D6/446
2004/0195943 A1 * 10/2004 Bowers et al. ..... 312/258
2004/0262307 A1 * 12/2004 DeCarlo et al. ..... 220/6
2005/0121448 A1 * 6/2005 Rader ..... 220/6

* cited by examiner

COLLAPSIBLE STORAGE CONTAINER FOR OFFICE AND PERSONAL USE

CROSS REFERENCE TO RELATED APPLICATIONS

The present application claims the benefit or priority to provisional application Ser. No. 60/474,698, filed May 30, 2003.

FIELD OF THE INVENTION

The present invention relates to a collapsible storage container apparatus for office and personal use that can include hanging file rails or guides for organizational items such as hanging file folders or dividers.

BACKGROUND OF THE INVENTION

In general, storage containers for home and office use are bulky and take up too much storage space for both the consumer as well as the distributor and retailer when empty. Even when storage containers are collapsible and can disassemble when not in use, these containers can be difficult to disassemble and then re-assemble. When disassembled, collapsible storage containers tend to have irregular configurations and do not easily lie flat so as to fit in a lid for storage purposes. When empty and not in use, the consumer may desire to easily collapse the container and be able to store it on a shelf, in a closet or under a bed, while taking a minimal amount of space and laying flat. Given the irregular shape of existing collapsible and non-collapsible containers, it is often difficult to efficiently store.

Also, collapsible storage containers lack the necessary components to accommodate popular organizational items such as hanging file folders. Collapsible storage containers are not currently designed to easily facilitate standard office organizational equipment such as dividers and hanging files for instance, because the components necessary to accommodate these items are difficult to incorporate into a collapsible design or result in a collapsible container that does not collapse flat for easy storage. Finally, many existing collapsible storage containers are not designed to withstand the rigors of being collapsed and re-assemble multiple times.

As mentioned above, the distributors and retailers of such collapsible storage containers also encounter difficulties with current storage containers. Specifically, stores that sell containers such as cardboard boxes or plastic storage totes for home and office use face transportation and display problems as they attempt to sell such storage containers. Storage containers that are shipped from the manufacturing site to the store need to use minimal space as possible on the truck or other delivery vehicle on which they are shipped. Often, containers are shipped pre-assembled resulting in maximum shipping and display space being used by such containers.

In order to overcome this problem, some manufacturers of storage containers design and make containers that are shipped in a collapsed or unassembled state. These containers, however, are often difficult to assemble and even though shipped in a collapsed or unassembled state are often in an irregular shape or configuration when collapsed.

By way of example, so-called banker's boxes, a storage box of cardboard with flaps for closing shut the box, are often shipped and purchased in an unassembled state. While shipped and purchased unassembled, the configuration of the banker box in this state is irregular and somewhat oblong. It tends to be a wasteful use of shipping space as well as display space given its irregular shape. It can also be difficult to assemble as it requires multiple flaps to be engaged against each other.

Thus, it is desirable to have a collapsible storage container for home and/or office use that is easy to collapse and re-assemble for shipping, display and storage. It is also desirable to have a collapsible storage container that incorporates components necessary to facilitate standard office organizational equipment such as dividers and hanging folders.

SUMMARY OF THE INVENTION

An embodiment of present invention provides a collapsible storage container for home and/or office use that incorporates organizational equipment such as hanging file folders or dividers.

In another embodiment, a collapsible storage container is provided that is easily assembled and conversely easily disassembled or collapsed.

In yet another embodiment, a collapsible storage container can be disassembled in such a manner that it lies flat with a regular configuration.

Embodiments of the present collapsible storage container invention are capable of being disassembled so that the container folds flat about a base or bottom of the container.

Embodiments are also provided wherein the collapsible storage container invention can fit into its detachable lid when in a disassembled state to facilitate easy storage, transport and display.

It is also desired to have a collapsible storage container that is water-resistant.

DETAILED DESCRIPTION

Figure 1:
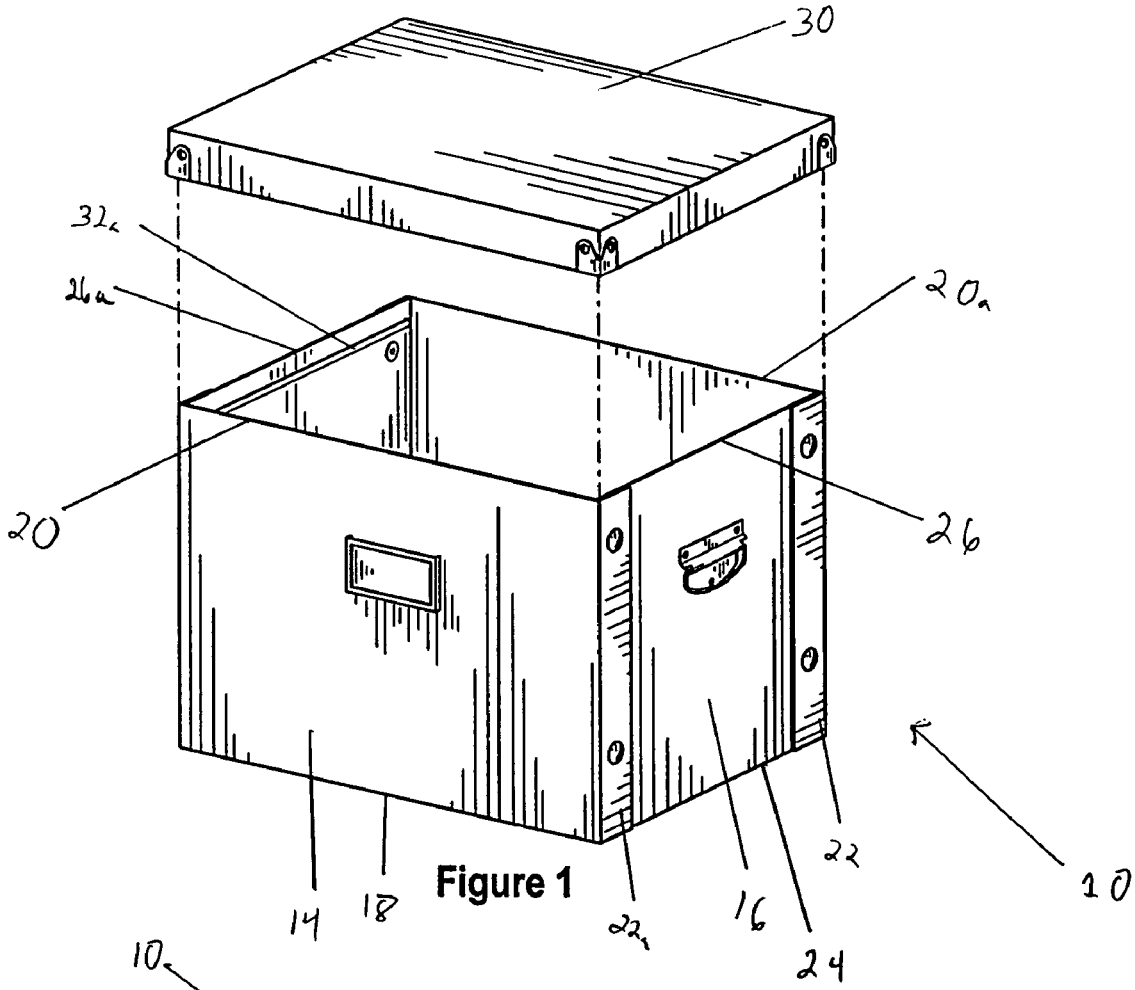
FIG. 1 is an environmental view of an embodiment of the present invention.

Referring now to the drawings, as seen in FIG. 1, there is shown an assembled storage container that can be easily collapsed and folded onto itself. As seen in FIG. 1, the storage container 10 includes a base or bottom 12 as well as opposing pairs of panels designated the side panels 14, 14*a* and the end panels 16, 16*a*. For purposes of this description, one of skill will readily understand that "interior" means the internal area formed by the assembled base 12 and panels 14, 14*a*, 16, 16*a*, while exterior designates the area external the assembled storage container 10.

The storage container 10 will typically be a box, including boxes fabricated from a base material. Exemplary base materials include fiberboard, cardboard and plastic, such as PVC, as well as cardboard having a water resistant paper, polymeric film or metallicized film layer or coating can be used in order to have a moisture resistant storage container. The storage container 10 can also be coated on its exterior surface with printable paper or film so that the container is decorated with graphics.

It is further contemplated that a variety of fabrics or materials may utilized either to cover the base material in order to improve performance characteristics, improve aesthetics or both. By way of example, such fabrics and materials include plush, suede, corduroy, snakeskin and psuedo snakeskin, waterproof plastic films and patterned or embossed films. The storage container may also be reinforced at its corners with metallic corner covers.

Figure 2:
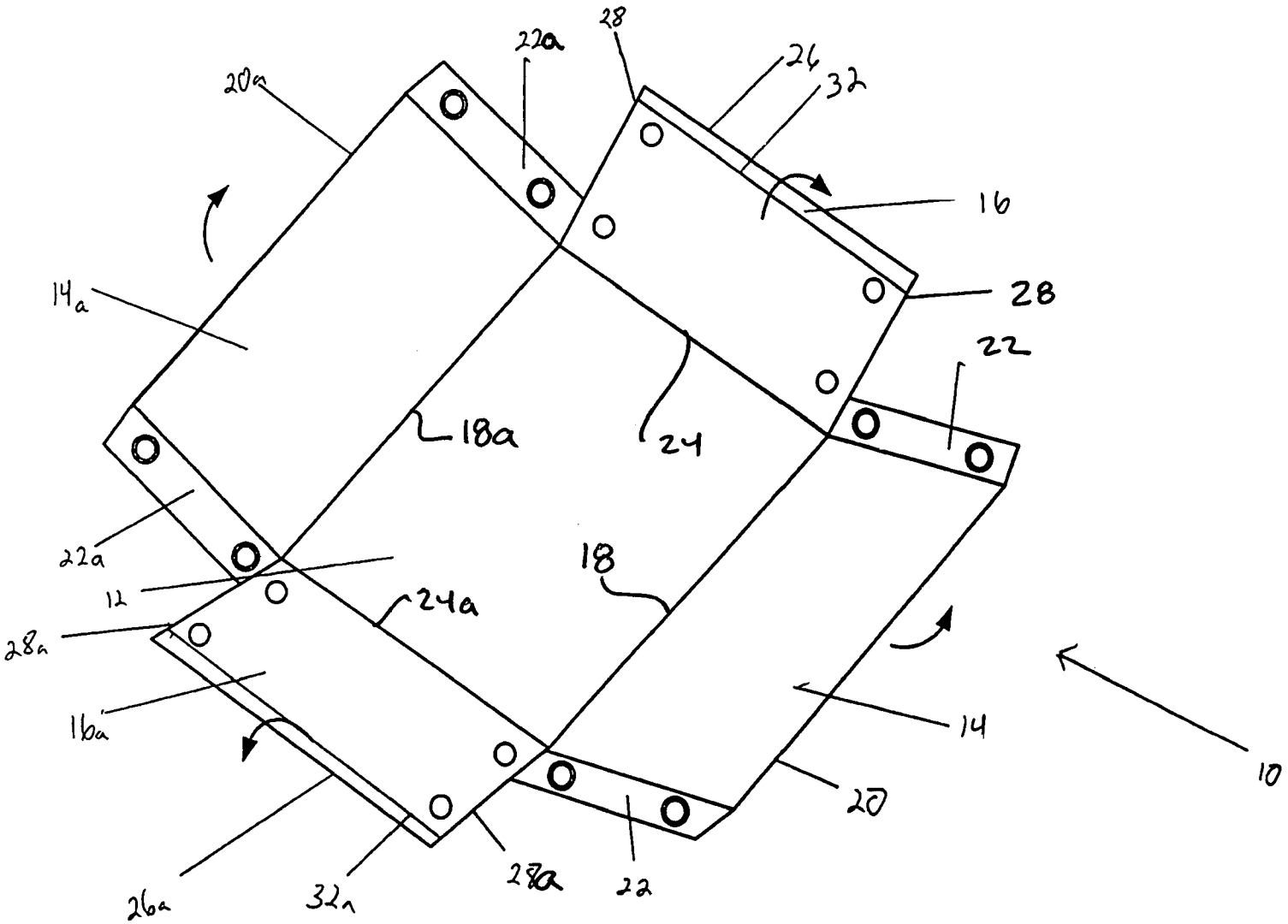
FIG. 2 is an environmental view of the embodiment of FIG. 1 where the invention is unassembled.

As seen in FIG. 2, the storage container 10 of FIG. 1 is in a state of being disassembled and folded up. As is illustrated each side panel 14, 14*a* is joined or connected to the base 12 at the side panel's base edge 18, 18*a* and has an opposing top edge 20 20*a*. As best seen in FIG. 2, each side panel also has opposing side edges 22, 22*a*. The end panels 16, 16*a* have a similar configuration comprising base edge 24, 24*a*, top edge 26 26*a*, and opposing side edges 28, 28*a*.

It is contemplated that the panels 14, 14*a*, 16, and 16*a* are connected to the base 12 via conventional means such as taping, gluing, or riveting the base edge of each panel to the base, as is well known in the art. It is further contemplated that the respective base edge of each panel must be relatively flexible so that at the base edge/base interface, the panel may folded or bent so that it lies substantially flat on the base, when disassembled. It is also contemplated that each base edge may include a gusset of flexible material including film, tape or paper to provide extra flexibility when folding the panel against the base during disassembly. It should also be understood that the panels and base can be a single, integral piece.

Figure 8:
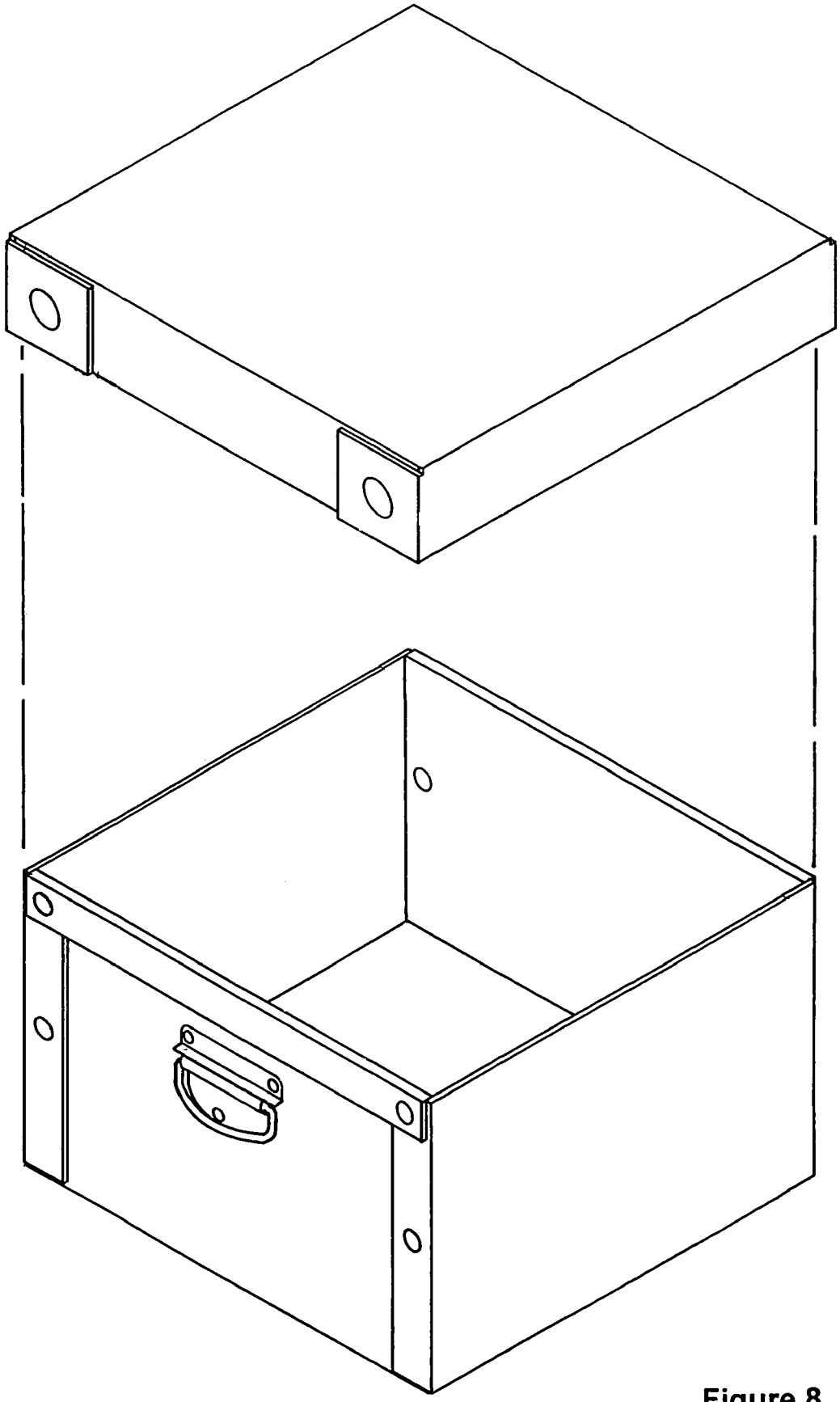
FIG. 8 is an environmental view of another embodiment of the present.

As is further illustrated in FIG. 2, the storage container 10 is assembled by connecting the panels 14, 14*a*, 16, 16*a* to the adjacent panels. As illustrated, the side edges 22, 22*a* of side panels 14, 14*a* are joined to side edges 28, 28*a* of end panels 16, 16*a*. The side edges 22, 22*a* of the side panels 14, 14*a* are joined to the side edges 28, 28*a* of the end panels 16, 16*a* by use of snaps that mate; i.e., have a male portion that mates with a female portion. Typically, the male portion of the snap will be located on the set of panels that include a handle(s). The male portion of the snap is placed in this manner so that the user does not pull apart or detach the snaps when grabbing the handles and picking up or otherwise moving the assemble box 10. It should be further that as seen in FIG. 8, a fold-over snap portion can be used to further secure the top snaps of the collapsible storage device in place. A fold-over snap portion is an elongated portion of the top edge of a panel. The fold-over snap portion will typically have two opposing portions of the snaps, typically the female portion, for engaging the topmost snap portions on the panel being joined. Thus, the fold-over typically has two female snap portions for engaging the top male snaps located on the panel being joined. During assemble, the fold-over snap portion is bent downward so that its snap portions engage the other portion of the snap. By utilizing the fold-over portion, the material strip of the fold-over position makes it more difficult for edges of the storage container from involuntarily pulling apart or separating once the container is assemble.

It is also contemplated that a variety of other connection and/or fixation systems may be used to fabricate the storage container. By way of example, strips of Velcro can utilized to join the panels in order to assemble the storage container. It is also contemplated that magnetic snaps, magnetic strips, adhesive strips, double stick tape and double stick foams may be used to assemble the storage container. Furthermore, one of skill in the art will readily appreciate that any number of other conventional fixation methods may be used to join or connect the panels to each other.

In order to assemble the storage container 10, the panels 14, 14*a*, 16 and 16*a* are folded so that they are relatively upright and generally forming the outer surfaces of a box. The side edge of a panel, such as an end panel, is then joined or connected to the side edge of the adjacent side panel as described above. The side edges, and thus ultimately the panels, are connected using the snaps, fasteners or Velcro strips as described above. This process is repeated until each panel is connected to the two adjacent panels to it.

The storage container can then be closed or sealed off by placing a lid on the top of the container. The lid 30 will have interior surfaces that frictionally engage the top edges of the assembled panels. It is contemplated that the lid will be fabricated from the same material as the storage container 10. It is also contemplated that the lid may have a handle.

Figure 3:
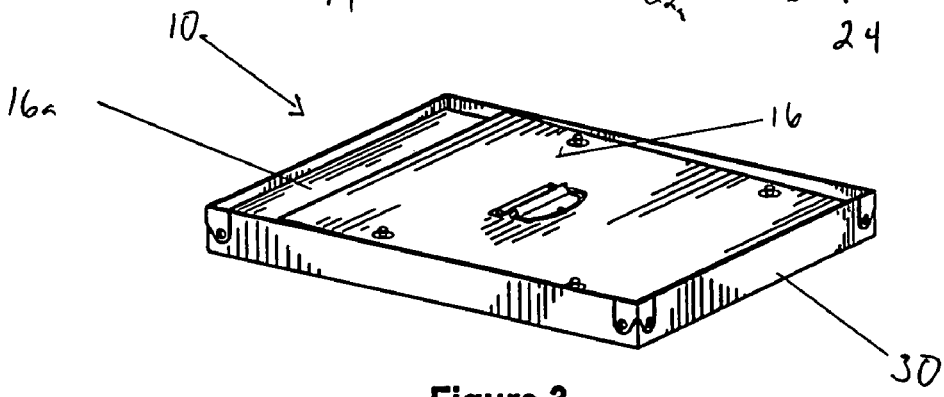
FIG. 3 is another environmental view of the embodiment of FIG. 1 where the invention is unassembled and collapsed.

Once assembled, the storage container 10 can be disassembled by disconnecting the now-connected side edges 22, 22*a*, 28, 28*a*; i.e., reversing the above-described process. As seen in FIG. 3, the panels 14, 14*a*, 16, 16*a* can then be folded down onto the base edge. It is contemplated that in order to achieve a substantially flat disassembled container one set of opposing panels will fold down onto the interior surface of the base 12 while the other set folds down onto the exterior surface of the base.

Once the container has been disassembled and collapsed, the resulting assembly can be placed for storage and/or transport into the lid 30. While it should be understood that either set of opposing panels can fold either way, for illustrative purposes, FIG. 2 shows the side panels 14, 14*a* being folded against the exterior surface of the base 12.

Figure 4:
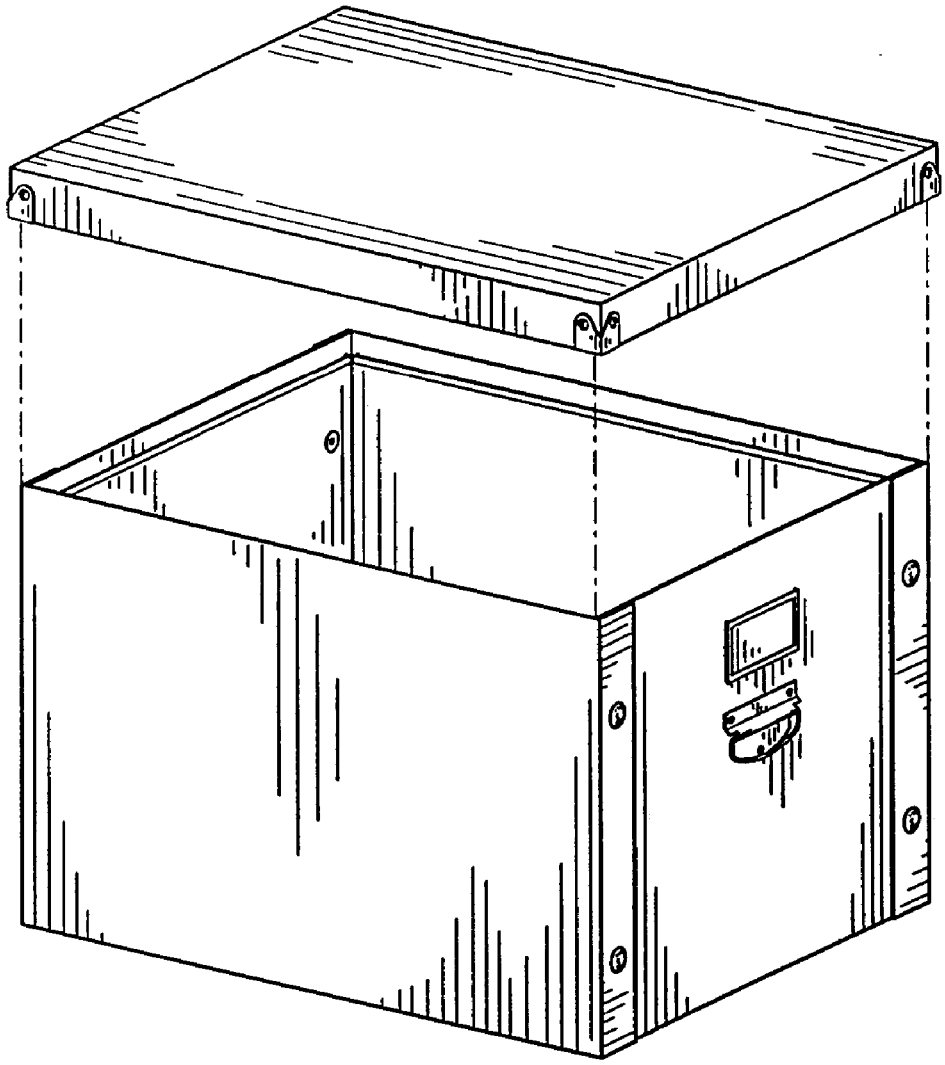
FIG. 4 is an environmental view of another embodiment of the present invention.
Figure 5:
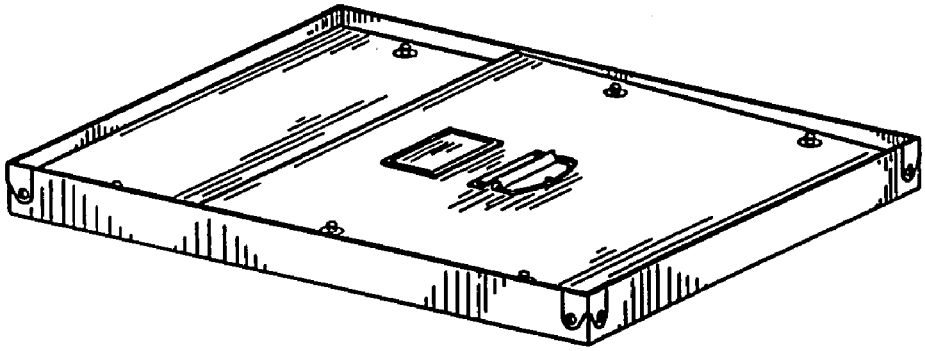
FIG. 5 is an environmental view of the embodiment of FIG. 4 where the invention is unassembled and collapsed.

In one embodiment, the lid 30 is sufficiently deep so that the entire collapsed assembly can be placed and held within the interior of the lid 30. This allows the assembly to be stored entirely within the lid 30 resulting in minimal use of space when being stored as well as when being shipped to a store. It allows merchants selling the collapsible storage 10 to maximize display space. Instead of having fully assembled boxes taking up precious shelf space, the merchant may simply assemble one collapsible storage container 10 for demonstration/display purposes and keep the remaining inventory collapsed. Thus, the collapsed storage container 10 requires less display space than assembled conventional boxes. As can be seen in FIGS. 1, 4, and 5, the corners of the lid may be reinforced with a metal or plastic plate in order to increase the strength and resiliency of the corners.

The storage container 10 will also have hardware necessary to support hanging file folders. As illustrated in FIGS. 1 and 4 the interior surface of the side panels 14, 14*a* has opposing hanging file rails 32, 32*a* glued or riveted thereto. The rails 32, 32*a* have a lip or recessed engaging surface from which hanging file folders may be hung. It is also contemplated that the rails 32, 32*a* may snap onto the interior surface of the side panel 14, 14*a* so that the tracks are removable when not in use. It is contemplated that depending upon the size of the container 10, opposing sets of rails 32, 32*a* may be utilized in order to accommodate different size files or folders. For instance, as illustrated in FIG. 4, the rectangular-shaped container has two set of rails so that in one direction, letter-sized folders are accommodated while in the opposing direction, legal-sized folders may be used. Finally, it is contemplated instead of the rails being attached to the interior surface of the side panels, the rails can be affixed to or about the top edges of the panels. The hanging files or folders can then engage the rails on the top edges of the panels with the lid having a sufficient over-hang to cover the hanging files or folders.

Figure 6:
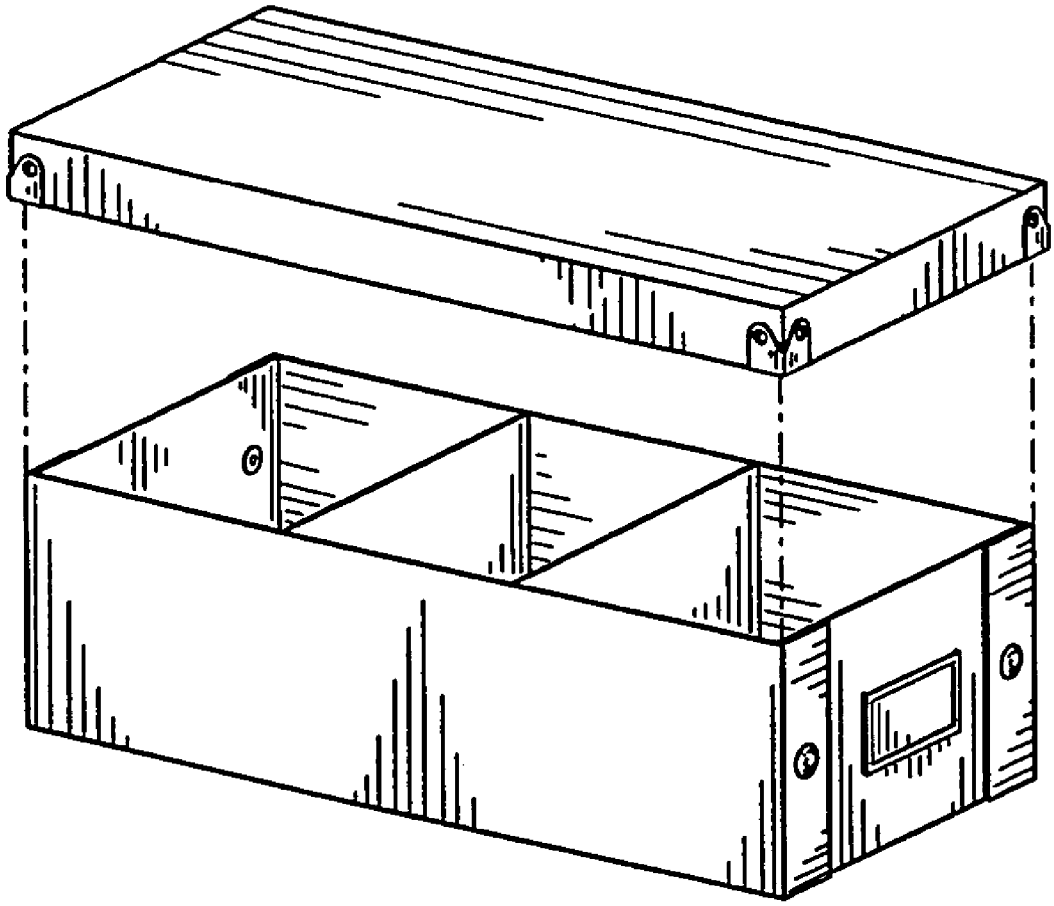
FIG. 6 is an environmental view of yet another embodiment of the present invention.
Figure 7:
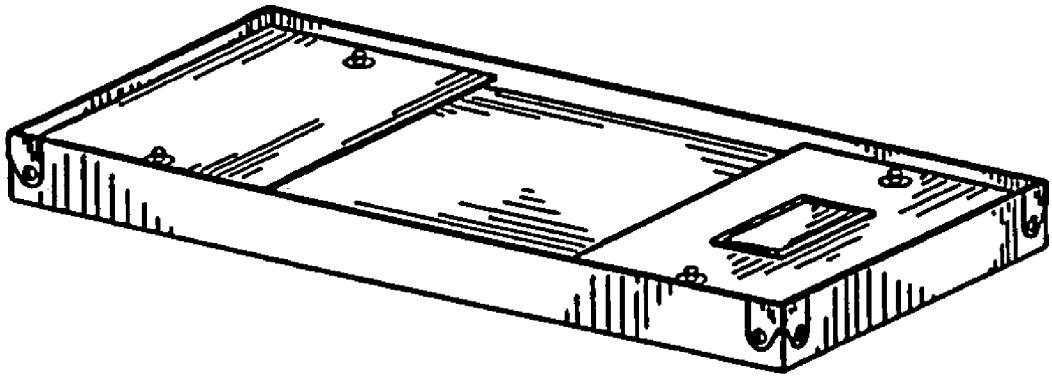
FIG. 7 is an environmental view of the embodiment of FIG. 6 where the invention is unassembled and collapsed.

As seen in FIGS. 6 and 7, it is also contemplated that the container 10 can have dividers included within the container's interior. It is also contemplated that these dividers are removable. Finally, one of skill will appreciate that the container can be manufactured in a variety of sizes in order to be stored, for instance under beds.

Figure 9:
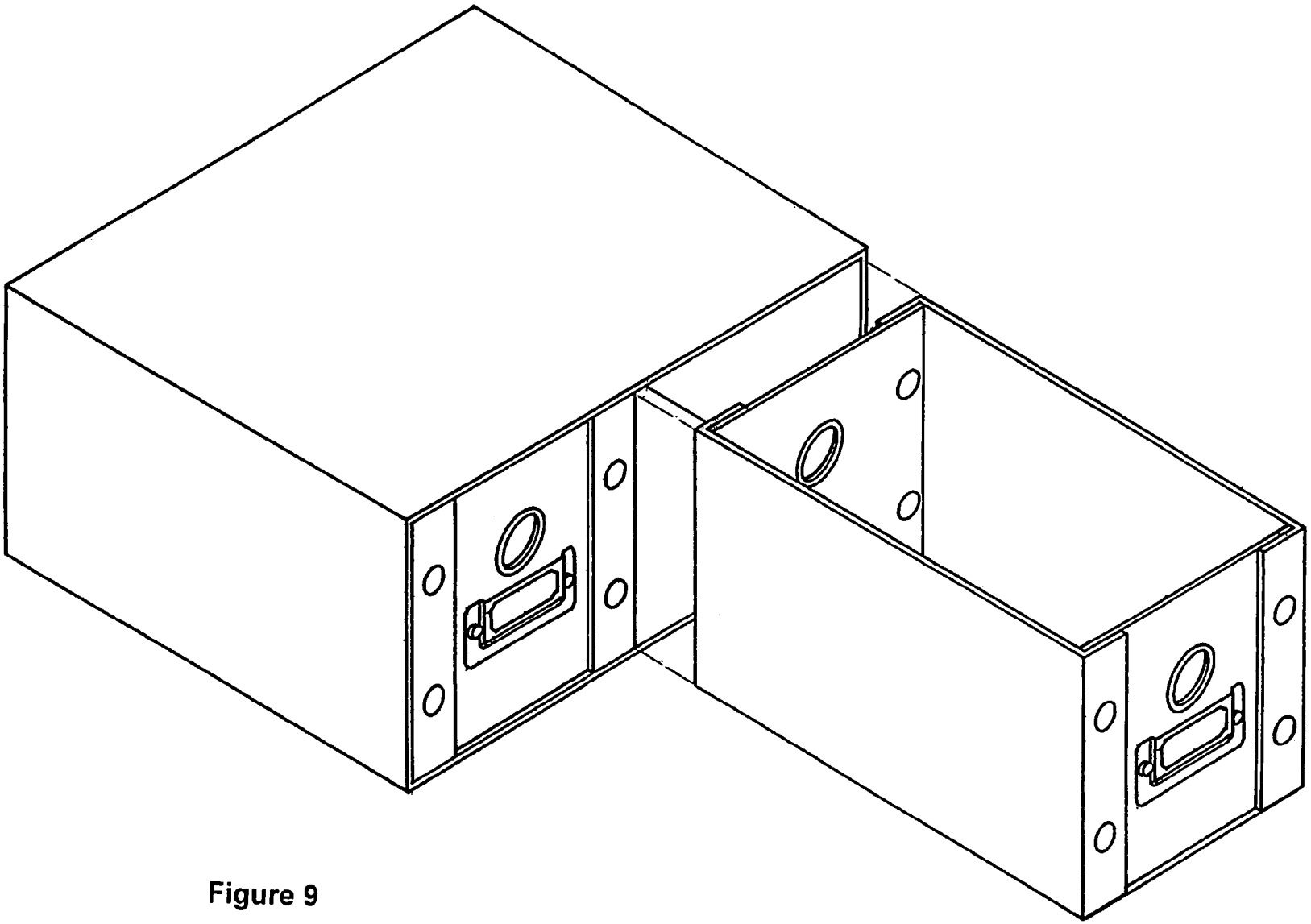
FIG. 9 is an environmental view of a media storage embodiment of the present invention.
Figure 10:
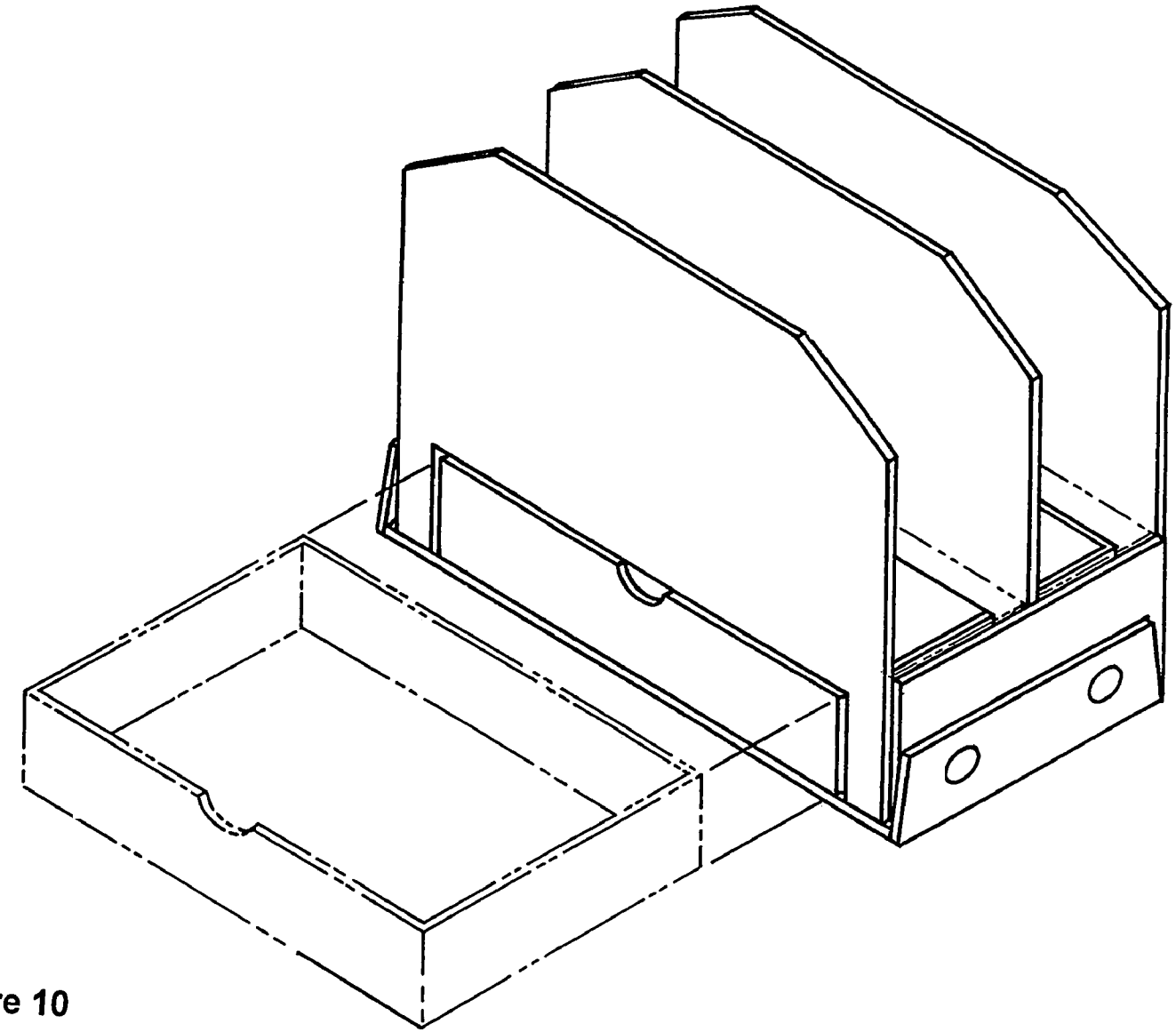
FIG. 10 is an environmental view of a letter holder embodiment of the present invention.
Figure 11:
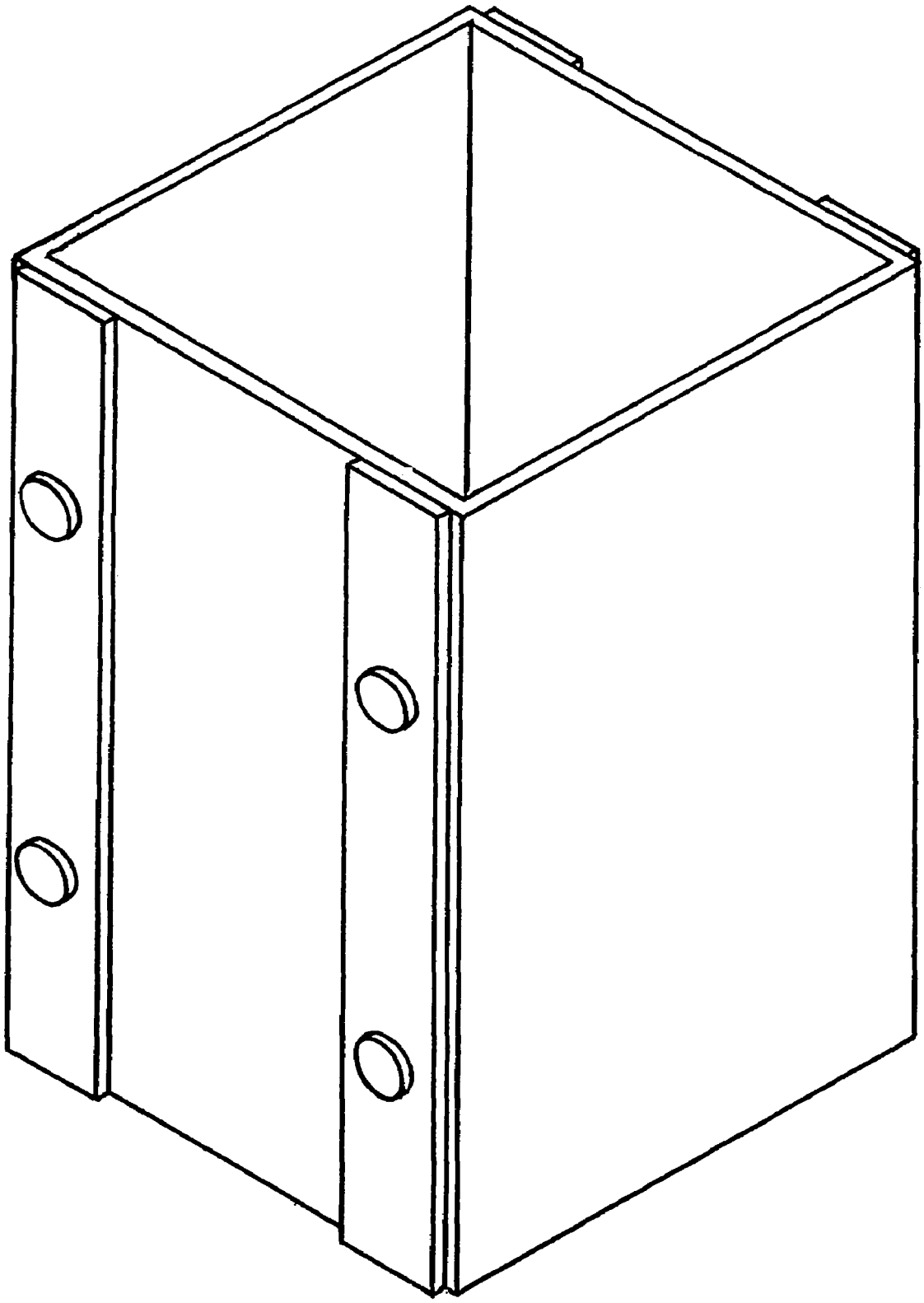
FIG. 11 is an environmental view of a pencil holder embodiment of the present invention.

It is also contemplated that the storage container 10 can include plastic sleeves that can be hung from the tracks for storage of CDs or DVDs as well having a series of snap-in tracks to support slide-in dividers or drawers, as illustrated in FIG. 9. Furthermore, the storage container can further be configured as a collapsible letter holder or pencil holder, as can be seen in FIGS. 10 and 11, respectively.

While in accordance with the patent statutes, the best mode and preferred embodiment has been set forth, the scope of the invention is not limited thereto, but rather by the scope of the attached claims. Although the invention has been described above in relation to specific forms, it should be evident to the persons skilled in the art that it may be modified and defined in various ways and should not be limited in interpretation, except by the terms of the following claims.

We claim:

1. An erectable and collapsible storage container, comprising:

a base having opposing first and second sides and opposing third and fourth sides extending between the first and second sides;

opposing first and second panels hingedly connected to said base along said opposing first and second sides of said base, respectively;

opposing third and fourth panels connected to said base along said opposing third and fourth sides of said base, respectively, said first, second, third, and fourth panels being movable to an erected position extending upwardly from said base to define an interior space of said container, each of said first panel and said second panel having a main portion and a pair of fold-over portions hingedly connected to opposing sides of the main portion, said fold-over portions being arranged to fold over to engage exterior surfaces of said third and fourth panels when the panels are in the erected position with each of said fold-over portions being positioned on the exterior of said container;

releasably securable fasteners provided on an interior surface of each of said fold-over portions and the exterior surfaces of said third and fourth panels, the releasably securable fasteners being releasably securable to releasably fasten said fold-over portions to said third and fourth end panels and secure the panels in the erected position;

a lid with a main wall and first, second, third and fourth peripheral walls extending from the main wall, the walls of the lid defining an interior space of the lid;

wherein the lid is configured to be seated atop upper edges of the first, second, third and fourth panels when in the erected position with the first, second, third and fourth walls of the lid positioned exteriorly of the first, second, third and fourth panels;

wherein the base and the first, second, third, and fourth panels are folded over one another in a flat arrangement and disposed within the interior space of the lid for compact storage.

2. The erectable and collapsible storage container according to claim 1, wherein each of said exterior surfaces of said third and fourth panels includes a handle.

3. The erectable and collapsible storage container according to claim 1, wherein said releasably securable fasteners include engaging male and female fasteners.

4. A method of erecting an erectable and collapsible storage container, the container comprising:

a base having opposing first and second sides and opposing third and fourth sides extending between the first and second sides;

opposing first and second panels hingedly connected to said base along said opposing first and second sides of said base, respectively;

opposing third and fourth panels connected to said base along said opposing third and fourth sides of said base, respectively, said first, second, third, and fourth panels being movable to an erected position extending upwardly from said base to define an interior space of said container, each of said first panel and said second panel having a main portion and a pair of fold-over portions hingedly connected to opposing sides of the main portion, said fold-over portions being arranged to fold over to engage exterior surfaces of said third and fourth panels when the panels are in the erected position with each of said fold-over portions being positioned on the exterior of said container;

releasably securable fasteners provided on an interior surface of each of said fold-over portions and the exterior surfaces of said third and fourth panels, the releasably securable fasteners being releasably securable to releasably fasten said fold-over portions to said third and fourth end panels and secure the panels in the erected position;

a lid with a main wall and first, second, third and fourth peripheral walls extending from the main wall, the walls of the lid defining an interior space of the lid;

wherein the lid is configured to be seated atop upper edges of the first, second, third and fourth panels when in the erected position with the first, second, third and fourth walls of the lid positioned exteriorly of the first, second, third and fourth panels;

wherein the base and the first, second, third, and fourth panels are folded over one another in a flat arrangement and disposed within the interior space of the lid for compact storage;

wherein the method comprises:

removing the base and the first, second, third and fourth panels hinged thereto from the interior space of the lid;

unfolding the first, second, third and fourth panels to the erected position;

folding over the fold-over portions of the first and second panels to engage the exterior surfaces of the third and fourth panels with each of the fold-over portions being positioned on the exterior of the container;

releasably fastening the releasably securable fasteners of the fold-over portions and the third and fourth panels to secure the first, second, third and fourth panels in the erected position; and seating the lid atop the upper edges of the first, second, third and fourth panels in the erected position with the first, second, third and fourth walls of the lid positioned exteriorly of the first, second, third and fourth panels.

* * * * *